US010239346B2

(12) United States Patent
Vermeulen

(10) Patent No.: US 10,239,346 B2
(45) Date of Patent: Mar. 26, 2019

(54) METHOD OF MANUFACTURING A FLOOR BOARD

(71) Applicant: Spanolux N.V.-Div.Balterio, Sint-Baafs-Vijve (BE)

(72) Inventor: Bruno Vermeulen, Aldeneik-Maaseik (BE)

(73) Assignee: UNILIN BVBA, Wielsbeke (BE)

( * ) Notice: Subject to any disclaimer, the term of this patent is extended or adjusted under 35 U.S.C. 154(b) by 0 days.

(21) Appl. No.: 14/678,653

(22) Filed: Apr. 3, 2015

(65) Prior Publication Data

US 2015/0328919 A1 Nov. 19, 2015
US 2016/0068010 A9 Mar. 10, 2016

Related U.S. Application Data

(63) Continuation of application No. 13/581,738, filed as application No. PCT/EP2011/053383 on Mar. 7, 2011, now abandoned.

(30) Foreign Application Priority Data

Mar. 5, 2010 (EP) ..... 10155673

(51) Int. Cl.
*B44C 1/20* (2006.01)
*B05D 7/00* (2006.01)
(Continued)

(52) U.S. Cl.
CPC ..... *B44C 1/20* (2013.01); *B05D 1/28* (2013.01); *B05D 3/067* (2013.01); *B05D 3/12* (2013.01);
(Continued)

(58) Field of Classification Search
None
See application file for complete search history.

(56) References Cited

U.S. PATENT DOCUMENTS 3,083,116 A * 3/1963 Berndt ..... B41M 7/02 427/189
3,440,076 A 4/1969 Vaurio
(Continued)

FOREIGN PATENT DOCUMENTS

DE 2334734 6/1974
DE 3249919 7/1991
(Continued)

OTHER PUBLICATIONS

European Search Report and the Written Opinion of the European Patent Office Patent Office in counterpart foreign application No. 10155673.6 filed Mar. 5, 2010.
(Continued)

*Primary Examiner* — Allan W. Olsen
(74) *Attorney, Agent, or Firm* — Steven M. Koehler; Westman, Champlin & Koehler, P.A.

(57) ABSTRACT

A method of manufacturing a floor board comprises the steps of supplying a panel, printing a curable substance or surface removing substance onto the panel in a predefined pattern for creating an elevation on the panel at the pattern or removing a portion of the surface of the panel at the pattern, respectively, and curing the curable substance or removing any re-action products of the surface removing substance and the panel.

18 Claims, 1 Drawing Sheet

(51) Int. Cl.

| | |
|---|---|
| ***B05D 3/06*** | (2006.01) |
| ***B44C 5/04*** | (2006.01) |
| ***B05D 3/12*** | (2006.01) |
| ***B44F 9/02*** | (2006.01) |
| ***B44C 1/22*** | (2006.01) |
| ***B05D 1/28*** | (2006.01) |
| ***B05D 5/02*** | (2006.01) |

(52) U.S. Cl.
CPC ..... *B05D 5/02* (2013.01); *B05D 7/542* (2013.01); *B44C 1/227* (2013.01); *B44C 5/0476* (2013.01); *B44F 9/02* (2013.01)

(56) References Cited

U.S. PATENT DOCUMENTS 3,446,184 A 5/1969 Johnson
3,545,997 A 12/1970 Hochberg
3,648,358 A 3/1972 Cannady
4,227,200 A 10/1980 Mansukhani
4,312,268 A 1/1982 King
4,504,523 A 3/1985 Miller
4,689,259 A 8/1987 Miller
4,796,402 A 1/1989 Pajala
4,833,530 A 5/1989 Kohashi
4,880,689 A 11/1989 Park
4,943,816 A 7/1990 Sporer
5,204,055 A 4/1993 Sachs
5,498,466 A 3/1996 Navarro
5,565,246 A * 10/1996 Hyde ..... B41M 7/02 427/504
5,594,484 A 1/1997 Furukawa
5,627,578 A 5/1997 Weintraub
5,778,789 A 7/1998 Krishnan
6,387,457 B1 5/2002 Jiang
6,394,595 B1 5/2002 Jiang
6,402,317 B2 6/2002 Yanagawa
6,422,696 B1 7/2002 Takahashi
6,439,713 B1 8/2002 Noguchi
6,465,046 B1 * 10/2002 Hansson ..... B32B 5/30 427/256
6,579,616 B1 6/2003 Beckman
7,357,959 B2 * 4/2008 Bauer ..... B05B 12/122 427/258
7,383,768 B2 6/2008 Reichwein
7,632,561 B2 12/2009 Thiers
8,114,513 B2 2/2012 Rentschler
8,337,947 B2 12/2012 Camorani
9,079,212 B2 7/2015 Pervan
9,371,456 B2 * 6/2016 Pervan ..... B41J 3/28
9,528,011 B2 * 12/2016 Pervan ..... B41J 3/28
9,630,404 B2 * 4/2017 Pervan ..... B41J 3/28
9,670,371 B2 * 6/2017 Pervan ..... B41J 3/28
9,738,095 B2 * 8/2017 Pervan ..... B41J 3/28
9,873,803 B2 * 1/2018 Pervan ..... B41J 3/28
10,029,484 B2 * 7/2018 Pervan ..... B41J 3/28
2001/0005542 A1 6/2001 Graab
2001/0022607 A1 9/2001 Takahashi
2002/0149137 A1 10/2002 Jang
2003/0108718 A1 6/2003 Simon
2003/0167717 A1 9/2003 Garcia
2004/0101619 A1 5/2004 Camorani
2004/0142107 A1 7/2004 Eriksson
2004/0153204 A1 * 8/2004 Blanco ..... B44F 11/02 700/207
2004/0177788 A1 9/2004 Rick
2004/0217186 A1 11/2004 Sachs
2005/0013932 A1 * 1/2005 Dennis ..... B41M 7/0045 427/180
2005/0128274 A1 6/2005 Matsushima
2005/0176321 A1 8/2005 Crette
2005/0249923 A1 11/2005 Reichwein
2006/0188670 A1 8/2006 Kojima
2006/0246266 A1 11/2006 Hall
2007/0049047 A1 3/2007 Fujimoto
2007/0091160 A1 4/2007 Kis
2007/0107344 A1 5/2007 Kornfalt
2007/0193174 A1 * 8/2007 Vogel ..... B44C 1/24 52/483.1
2007/0209736 A1 9/2007 Deringor et al.
2007/0240585 A1 10/2007 Vaish
2007/0283648 A1 * 12/2007 Chen ..... B41J 3/407 52/313
2007/0299196 A1 12/2007 Ohkoshi
2008/0010924 A1 1/2008 Petruczynik
2008/0185092 A1 8/2008 Blenkhorn
2008/0241472 A1 10/2008 Shiao
2008/0261003 A1 10/2008 Lewis
2009/0010682 A1 1/2009 Camorani
2009/0031662 A1 2/2009 Chen
2009/0047480 A1 2/2009 Juers
2009/0116966 A1 5/2009 Athoff
2009/0155612 A1 * 6/2009 Pervan ..... B32B 21/02 428/498
2009/0252925 A1 * 10/2009 Provoost ..... B44C 3/025 428/151
2010/0192793 A1 * 8/2010 Verhaeghe ..... B44C 5/0469 101/492
2010/0196678 A1 * 8/2010 Vermeulen ..... B44C 5/0446 428/195.1
2010/0260969 A1 * 10/2010 Vermeulen ..... B44F 9/02 428/141
2010/0300020 A1 * 12/2010 Vermeulen ..... B44C 5/0484 52/177
2010/0300030 A1 * 12/2010 Pervan ..... B33B 21/02 52/588.1
2011/0024938 A1 2/2011 Tripp
2011/0097506 A1 * 4/2011 Shah ..... B41M 5/025 427/458
2011/0129640 A1 6/2011 Beall
2011/0189471 A1 6/2011 Ziegler
2011/0167744 A1 * 7/2011 Whispell ..... E04F 15/02 52/309.1
2011/0171412 A1 7/2011 Dohring
2011/0237739 A1 9/2011 Tada
2011/0247748 A1 10/2011 Pervan
2011/0250404 A1 * 10/2011 Pervan ..... B44C 5/0446 428/173
2011/0261464 A1 10/2011 Hoffman
2011/0262720 A1 * 10/2011 Riebel ..... B32B 7/12 428/195.1
2011/0268937 A1 * 11/2011 Schacht ..... B44C 1/10 428/205
2012/0015107 A1 * 1/2012 Schacht ..... B44C 1/10 427/261
2012/0176443 A1 7/2012 Robertson
2012/0196081 A1 8/2012 Gleich
2013/0043211 A1 2/2013 Vermeulen
2013/0170218 A1 * 7/2013 Wolk ..... G02B 6/005 362/296.01
2014/0017452 A1 1/2014 Pervan
2014/0023832 A1 1/2014 Pervan
2014/0028772 A1 * 1/2014 Pervan ..... B41J 2/485 347/110
2014/0196618 A1 7/2014 Pervan
2014/0198168 A1 7/2014 Pervan
2014/0198170 A1 7/2014 Pervan
2014/0199495 A1 7/2014 Pervan
2014/0199513 A1 7/2014 Pervan
2014/0199531 A1 7/2014 Pervan
2014/0220318 A1 8/2014 Pervan
2015/0030817 A1 1/2015 Wiegelmann
2015/0239230 A1 * 8/2015 Vermeulen ..... B41F 19/02 101/27
2015/0274997 A1 10/2015 Pervan
2015/0328919 A1 11/2015 Vermeulen
2016/0068010 A9 * 3/2016 Vermeulen ..... B44C 1/20 427/510
2016/0144612 A1 5/2016 Pervan
2016/0208116 A1 * 7/2016 Pervan ..... B41J 3/28
2016/0250853 A1 * 9/2016 Pervan ..... B41J 3/28 347/56

(56) References Cited

U.S. PATENT DOCUMENTS

| | | | | |
|---|---|---|---|---|
| 2017/0066255 | A1* | 3/2017 | Pervan | B41J 3/28 |
| 2017/0204281 | A1* | 7/2017 | Pervan | B41J 3/28 |
| 2017/0232761 | A1* | 8/2017 | Pervan | B41J 3/28 347/102 |
| 2017/0348984 | A1* | 12/2017 | Pervan | B41J 3/28 |
| 2018/0111390 | A1* | 4/2018 | Pervan | B41J 3/28 |
| 2018/0127605 | A1* | 5/2018 | Pervan | B41J 3/28 |
| 2018/0298216 | A1* | 10/2018 | Pervan | B41J 3/28 |

FOREIGN PATENT DOCUMENTS

| | | | |
|---|---|---|---|
| DE | 202004018710 | | 3/2005 |
| DE | 102007019871 | | 10/2008 |
| EP | 0403264 | | 12/1990 |
| EP | 0657309 | | 6/1995 |
| EP | 0769535 | A2 | 9/1997 |
| EP | 1020303 | | 7/2000 |
| EP | 1020765 | A1 | 7/2000 |
| EP | 1209199 | A1 | 5/2002 |
| EP | 1584378 | | 10/2005 |
| EP | 2108524 | | 10/2009 |
| EP | 2110267 | | 10/2009 |
| EP | 2213476 | | 8/2010 |
| EP | 2363288 | | 9/2011 |
| EP | 2363299 | B1 | 10/2012 |
| EP | 2542426 | B1 | 1/2013 |
| GB | 1215551 | | 12/1970 |
| GB | 2065556 | | 7/1981 |
| GB | 2128898 | | 5/1984 |
| GB | 2419110 | | 4/2006 |
| JP | 6-287467 | | 10/1994 |
| JP | 2001-311254 | A | 11/2001 |
| JP | 2005097339 | | 4/2005 |
| JP | 2008-156573 | | 7/2008 |
| JP | 2008-265229 | | 11/2008 |
| JP | 2009-173003 | | 8/2009 |
| JP | 2010-209325 | | 9/2010 |
| KR | 2009-0112326 | | 10/2009 |
| WO | 9015673 | | 12/1990 |
| WO | 9845129 | | 10/1998 |
| WO | 01/72489 | | 10/2001 |
| WO | 02/42373 | A1 | 5/2002 |
| WO | 03057488 | A1 | 7/2003 |
| WO | 2005/097874 | | 10/2005 |
| WO | 2005/120847 | | 12/2005 |
| WO | 2006/057241 | A1 | 6/2006 |
| WO | 2006/125036 | A2 | 11/2006 |
| WO | 2007033031 | | 3/2007 |
| WO | 2007/060298 | | 5/2007 |
| WO | 2007/096746 | | 8/2007 |
| WO | 2007/125098 | A1 | 11/2007 |
| WO | 2008/042088 | A1 | 4/2008 |
| WO | 2008/121749 | | 10/2008 |
| WO | 2009/030935 | | 3/2009 |
| WO | 2009/065769 | | 5/2009 |
| WO | 2009074174 | | 6/2009 |
| WO | 2010/070485 | | 6/2010 |
| WO | 2011/064075 | | 6/2011 |
| WO | 2011/107610 | | 9/2011 |
| WO | 2011/129757 | A1 | 10/2011 |
| WO | 2012/007230 | | 1/2012 |
| WO | 2012/141651 | | 10/2012 |
| WO | 2014/037823 | A1 | 3/2014 |

OTHER PUBLICATIONS

Odian, George, "Principles of Polymerization" 1991, 3rd Edition, 5 pages incl. pp. 122-123, John Wiley & Sons, Inc. New York, NY.

Hudd, "Chapter 1: Inkjet Printing Technologies," Chemistry of Inkjet Inks, 2010, pp. 3-18, World Scientific Publishing Co, PTE. Ltd., Published in Singapore and Hackensack NJ.

Owens, James C. "A Tutorial on Printing," Imaging.org Resources, 2010 pp. 1-5, Society for Imaging Sciences and Technology, retrieved Jul. 27, 2015 from http://web.archive.org/web/20100706153535/http://www.imaging.org/ist/resources/tutorial.

"Digital," Definition by Merriam-Webster, 2015, pp. 1-5, retrieved Aug. 6, 2015 from http://www.merriam-webster.com/dictionary/digital.

Pervan, Darko, Technical Disclosure entitled "Digital Printing and Embossing" IP.com No. IPCOM000224950D, IP.com PriorArtDatabase, Jan. 15, 2013.

International Search Report issued in PCT/SE2014/050022, dated May 26, 2014.

Pervan, Darko, Technical Disclosure entitled "Digital Overlay" IP.com No. IPCOM000225271, IP.com PriorArtDatabase, Feb. 5, 2013.

Canadian Office Action for Canadian patent application No. 2,791,216, dated Dec. 15, 2016.

Canadian Office Action dated Sep. 25, 2018, for corresponding Canadian Patent Application No. 2984272, filed Sep. 9, 2011.

* cited by examiner

METHOD OF MANUFACTURING A FLOOR BOARD

CROSS-REFERENCE TO RELATED APPLICATION

This application is a continuation and claims priority under 35 USC 120 of U.S. Ser. No. 13/581,738 filed Aug. 29, 2012, which is a Section 371 National Stage Application of International Application PCT/EP2011/053383 filed Mar. 7, 2011 and published as WO/2011/107610 A1 in English, both of which are incorporated herein in their entirety.

BACKGROUND

The discussion below is merely provided for general background information and is not intended to be used as an aid in determining the scope of the claimed subject matter.

Aspects of the invention relate to a method of manufacturing a floor board.

In the field of the flooring industry, like in several other industries, there is a trend to mass customization. This means that there is a demand for products that suit to specific customers. As a consequence, a high degree of flexibility in production processes is required.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the Background.

A method of manufacturing a floor panel according to an aspect of the invention, which comprises supplying a panel, printing a curable substance or surface removing substance onto the panel in a predefined pattern for creating an elevation on the panel at the pattern or removing a portion of the surface of the panel at the pattern, respectively, and curing the curable substance or removing any reaction products of the surface removing substance and the panel, hence forming the floor board.

Due to the method it is not necessary to use relatively expensive embossed press plates or press rollers to be pressed under high pressure on the panel in order to create an embossed surface of the floor board. Furthermore, the method provides the opportunity to create a high degree of variations in relief patterns of floor boards. A comparable degree of variation in case of using different embossed press plates or press rollers would be more expensive.

In an embodiment the step of printing is digitally controlled and/or non-contact printing and/or non-contact printing. Due to the digitally controlled step a quick switch to manufacturing floor boards having alternative relief patterns can be effected. This introduces a great flexibility in relief patterns and avoids the necessity of repetitive embossment such as in case of prior art relief press rollers or relief press plates. This means that a standardized basic product can be efficiently further treated to form a unique product corresponding to individual customer desires. More specifically, it is possible that the substance is printed onto the panel via a digitally controlled printing nozzle.

Nevertheless, it is also conceivable to print the curable substance or surface removing substance onto the panel through roller printing or an alternative prior art printing method. In order to change the pattern to be printed a plurality of printing rollers having different patterns can be used. For example, they may be revolver-mounted in order to be able to quickly change to a different pattern to be printed onto the panel.

The panel may comprise a substrate of HDF, WPC (Wood Plastic Composite), polymeric composite (engineered polymer), PVC, LVT (Luxury Vinyl Tile) or the like. The panel may be provided with a decorative basic pattern, which is directly printed on the substrate or laminated thereon by means of a known method of laminating. Furthermore, the supplied panel may already comprise an embossment, but may also have a flat surface on which the curable substance or the surface removing substance is printed. The curable substance may be cured by curing means, for example by means of UV radiation or a UV laser. Alternative curing means may comprise electron-beam heating, or normal heating at elevated temperature; for example, the entire panel including the curable substance may be placed in a heated environment so as to cure the substance.

The curable substance may comprise wear resistant particles in order to provide good wear performance of the elevated portions of the floor board in use.

In a specific embodiment the predefined pattern substantially corresponds to a decorative basic pattern being present on the panel. This means that the floor board will be provided with embossment in register. In practice, the pattern may be a wood grain pattern where the wood grains are depressed portions and the surrounding portions are elevated portions. The depressed portions can be made by printing a surface removing substance at the intended depressed portions or printing a curable substance beside of the intended depressed portions.

The curable substance or surface removing substance may be printed onto the panel by first printing a liquid onto the panel in said predefined pattern, and then providing an intermediate substance to the liquid, wherein the intermediate substance or the liquid together with the intermediate substance form the curable substance or surface removing substance. In practice, the intermediate substance may comprise a powder. This can be applied onto the liquid and stick to the liquid, whereas abundant powder is removed, for example by a suction device. In one embodiment, the intermediate substance contains wear resistant particles since this provides the opportunity to print the liquid without wear resistant particles onto the panel so as to avoid wear of a printing head, whereas the powder including wear resistant particles can be applied less accurate to the printed liquid.

In practice the maximal thickness of the curable substance lies between 50 and 250 μm, but a thinner or thicker layer is conceivable. Preferably, the maximal thickness lies between 5 and 1000 μm.

The curable substance may contain a varnish, which is lustrous or matte, for example.

It is also possible that the panel is a flexible sheet which is laminated to a substrate after printing the curable substance or surface removing substance thereon so as to form the floor board. For example, the sheet is a paper sheet which is already provided with a resin or still has to be provided with a resin.

In an alternative embodiment the method comprises the steps of supplying a panel, applying a curable substance or surface removing substance onto the panel in a predefined pattern for creating an elevation on the panel at the pattern or removing a portion of the surface of the panel at the pattern, respectively, wherein the substance is applied onto the panel by first putting a layer of the substance onto the panel and then creating the predefined pattern by a digitally controlled impacting member which is pressed into said substance and movable in a plane extending parallel to the panel so as to form the pattern, curing the curable substance or removing any reaction products of the surface removing substance and the panel, hence forming the floor board. The advantage of the method is that using expensive prior art embossed press plates is not necessary to create embossed floor boards, whereas quick changes to the desired relief pattern can be achieved.

In practice the impacting member will be smaller than the dimensions of the panel. The impacting member may be comparable to a conventional dot matrix printer, in which digitally controlled pins impact on a paper via an ink ribbon. This method is applicable in case of partly cured top layers, such as polyurethane (PU) hot coating top layers. The control of the impacting member can be based on image recognition, for example cameras that recognize the pattern of approaching panels.

BRIEF DESCRIPTION OF THE DRAWINGS

Aspects of the invention will be explained in more detail hereinafter with reference to drawings, which are very schematic representations of embodiments of the invention.

DETAILED DESCRIPTION OF THE ILLUSTRATIVE EMBODIMENT

Figure 1:
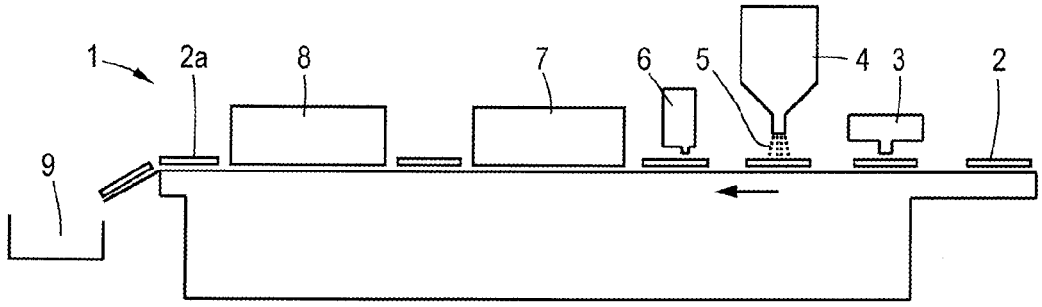
FIG. 1 is a schematic side view of an apparatus for performing an embodiment of the method.

FIG. 1 illustrates the main steps of an embodiment of the method. The manufacturing process performed by an apparatus 1 runs from the right to the left in FIG. 1. In this case a panel 2 is transported first to a digital printing station 3. At the digital printing station 3 a liquid is printed on an upper surface of the panel 2 in a predetermined pattern. The liquid may be an ink or varnish, being transparent or colored or any other liquid material.

Then, the printed panel 2 is transported to a powder unit 4, where an intermediate substance or a powder 5 is spread over the panel 2. The powder 5 will stick to the liquid. The liquid and the powder 5 form a substance which is curable. A part of the powder 5 may fall beside of the printed pattern or on a portion of the printed pattern which is already dry. That part of the powder 5 will be removed from the panel 2 by a suction device 6, but an alternative powder removing device is conceivable.

In a subsequent step the formed substance on the panel 2 is cured at a heating station 7. Before storing the resulting floor boards 2*a* at a storage station 9 the panels 2 may be cooled at a cooling station 8. In the heating station 7 the powder may be melted together into a single mass which is elevated above the initial upper surface of the panel 2. It is conceivable that the liquid and powder together form a curable substance or the powder itself forms a curable substance adhering to the panel 2 upon curing.

It is also conceivable that the powder forms the curable substance whereas the liquid pattern only functions as a temporary carrier for carrying the powder in the desired pattern. In this case the liquid may partly or fully disappear during the step of heating, for example by evaporation.

The powder 5 may be a swelling powder such that upon curing the volume of the substance becomes larger (and the elevations higher) than that of the sum of the liquid and the powder 5 separately. In practice, the maximal thickness of the substance after curing lies between 50 and 250 μm, but a higher or lower thickness is conceivable. In practice, a thickness of 5-1000 μm is preferred.

Furthermore, the powder 5 can also contain wear-resistant particles, for example corundum particles. It is advantageous that in the embodiment as illustrated in FIG. 1 the wear resistant particles are supplied separately from a printing head of the digital printing station, thus avoiding wear of the printing head through the presence of wear resistant particles.

Due to curing of the mixture of the liquid and the powder 5 or the powder 5 alone a solid elevated region arises on the panel 2 at the location where the liquid pattern was printed. The pattern may represent a real wood pattern or the like. The heating station 7 may comprise a UV-laser, for example, but alternative curing means are conceivable.

The apparatus of FIG. 1 may comprise a camera (not shown) for recognizing a basic pattern being printed on the panel 2 before arriving at the digital printing station 3. The pattern to be printed on the panel 2 at the digital printing station 3 may correspond to the basic pattern such that the panel 2 obtains an embossment in register.

Several types, shapes and dimensions of the powder 5 are conceivable. For example, metallic resin powder which creates a metallic effect after melting, lustrous resin powder in which lustrous particle are added to the powder, anti-static powder which avoids build-up of electrostatic charge, and powders which generate pearlescent effect, matte effect, or odour effect.

Figure 2:
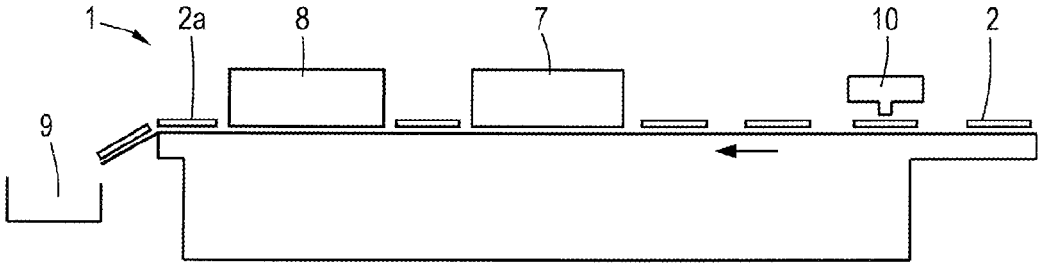
FIG. 2 is a similar view as FIG. 1 of an alternative embodiment.

In an alternative embodiment the curable substance is directly printed at the printing station 10 in a predetermined pattern on a panel 2. This is illustrated in FIG. 2. In this case, a relatively large amount of substance has to be printed by the printing station 10. Other features as described in relation to the embodiment as illustrated in FIG. 1 are also applicable to the embodiment as illustrated in FIG. 2.

Figure 3:
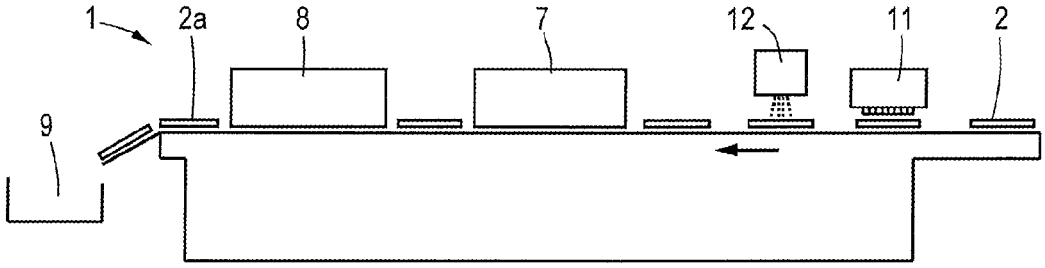
FIG. 3 is a similar view as FIG. 1 of another alternative embodiment.

In a further alternative embodiment of the method a layer of the substance is spread onto the panel 2 at a substance spread device 11 and then the predetermined relief pattern is created by a digitally controlled impacting member 12, see FIG. 3. In this case the substance may be spread uniformly over the panel 2. The digitally controlled impacting member 12 is repeatably pressed into the curable substance and movable in a plane extending parallel to the panel 2 so as to form the relief pattern. Other features as described in relation to the embodiment as illustrated in FIG. 1 are also applicable to the embodiment as illustrated in FIG. 3.

Instead of locally displacing the substance by an impacting member 12 it is also conceivable to remove the substance locally from the panel, for example by a suction device.

In another alternative method a surface removing substance can be applied on the panel (directly or indirectly via powder in a printed liquid as described hereinbefore) such that the local surface of the panel 2 at the intended pattern is removed. The substance can be applied on the panel in a manner as illustrated in FIGS. 1 and 2. The substance is selected such that it reacts with the surface of the panel 2 so as to remove a portion thereof. Contrary to the embodiments as described above the relief pattern of the panel 2 is formed by removing material from the panel 2 instead of adding material. After heating and/or cooling of the substrate on the panel any reaction products may be removed by pressed air, for example. It is also possible that neither heating nor cooling is necessary in this embodiment. After applying the embossment in this way the panel may be covered with a finishing layer containing wear resistant particles.

Alternatively, the surface removing substance is selected such that it reacts with the surface of the panel 2 after being activated. For example, the substance can be activated by a heat source, UV radiation, a laser beam or the like. When the surface removing substance is printed in a predefined pattern onto the panel 2, an activation device needs not to be focussed very accurately on specific areas of the panel surface since only those areas will be activated where the substance is present. After activation and reaction of the substance with the panel surface, any reaction products may be removed.

Panels having the same decorative basic pattern may be provided with different relief patterns, for example one of the type embossing-in-register and the other one of the type brushed all-over. This enlarges the variation of appearances of floor boards.

The panel 2 on which the curable substance or surface removing surface is applied, may be made of HDF, WPC, polymer composite or engineered polymer, LVT, PVC or the like. It is noted that the method can also be applied on a flexible sheet which will be laminated to a substrate at a later stage so as to form a floor board.

The invention is not limited to the embodiments shown in the figures, which can be varied in several ways within the scope of the invention. It is for example possible that the method is applied on alternative substrates than on a panel or a sheet, for example on the packaging material of floor panels. Furthermore, the digital printing station may be replaced by alternative printing means, for example a conventional printing roller as known from the prior art roller printing process.

What is claimed is:

1. A method of manufacturing a panel having an upper surface with surface portions of varying thickness, comprising:

supplying a panel;

transporting said panel to a digital printing station;

at said digital printing station, printing a liquid on said upper surface of said panel in a predefined pattern, wherein the predefined pattern substantially corresponds to a decorative basic pattern being present on the panel;

transporting said panel to a powder spreading station;

at said powder spreading station, combining a powder and said liquid by spreading said powder over said upper surface having said liquid, said predefined pattern of liquid comprising wet portions, wherein a first part of said powder sticks to said wet portions and a second part of said powder lays beside said wet portions;

transporting said panel to a powder removing station;

at said powder removing station, removing said second part of said powder, said first part of said powder together with said liquid being a curable substance; and curing said curable substance, wherein said first part of said powder adheres to said upper surface, wherein said curing creates an elevated surface portion on said upper surface at said predefined pattern of liquid, and wherein the powder comprises wear resistant particles, a swelling powder, a metallic resin powder, a lustrous resin powder, an anti-static powder, a pearlescent effect generating powder, a matte effect generating powder or an odour effect generating powder.

2. The method according to claim 1, wherein the powder comprises wear resistant particles.

3. The method according to claim 1, wherein the powder comprises a swelling powder such that upon curing the curable substance the volume of the curable substance becomes larger than that of the sum of the liquid and the powder separately.

4. The method according to claim 1, wherein said curing includes curing the curable substance using ultraviolet (UV) radiation.

5. The method according to claim 1, wherein a maximal thickness of the curable substance is between 20 and 250 μm.

6. The method according to claim 1, wherein a maximal thickness of the curable substance is between 5 and 1000 μm.

7. The method according to claim 1, wherein the curable substance contains a varnish.

8. The method according to claim 1, further comprising after creating the curable substance laminating a substrate to the panel.

9. The method of claim 8, wherein the panel is a flexible sheet.

10. The method of claim 9, wherein said flexible sheet is a paper sheet.

11. The method of claim 10, further comprising providing said paper sheet with resin.

12. The method of claim 1, wherein said curing comprises heating said curable substance by a heat source.

13. The method of claim 1, wherein said liquid is a curable substance.

14. The method of claim 1, wherein said powder is a curable substance.

15. The method of claim 1, wherein said curing creates an elevated surface portion on said upper surface at said predefined pattern of liquid.

16. The method of claim 1, wherein said panel comprises a substrate including at least one of HDF, Wood Plastic Composite, polymeric composite and polyvinyl chloride.

17. The method of claim 1, wherein said powder comprises particles of corundum.

18. The method of claim 1, wherein after said curing, a liquid free upper surface is obtained.

* * * * *